United States Patent [19]

Mahlich et al.

[11] Patent Number: 4,658,511

[45] Date of Patent: Apr. 21, 1987

[54] ELECTRIC HAIR DRYER WITH AIR DISPERSING HOOD

[75] Inventors: Gotthard C. Mahlich; Rudolf Maass, both of Solingen, Fed. Rep. of Germany

[73] Assignee: Robert Krups Stiftung & Co. KG, Solingen, Fed. Rep. of Germany

[21] Appl. No.: 767,413

[22] Filed: Aug. 20, 1985

[30] Foreign Application Priority Data

Sep. 19, 1984 [DE] Fed. Rep. of Germany ..... 3434289

[51] Int. Cl.[4] ..... A45D 20/18

[52] U.S. Cl. ..... 34/97; 34/99; 34/101; 219/367; 219/371

[58] Field of Search ..... 34/96, 97, 99, 101; 219/366, 367, 368, 369, 371; 415/143; 417/371, 368

[56] References Cited

U.S. PATENT DOCUMENTS

| | | | |
|---|---|---|---|
| 3,308,268 | 3/1967 | Laing | 34/96 |
| 3,955,065 | 5/1976 | Chamboy | 34/97 |
| 4,038,759 | 8/1977 | Dyer et al. | 34/99 |
| 4,309,595 | 1/1982 | Long et al. | 34/96 |
| 4,384,411 | 5/1983 | Stiegler et al. | 34/99 |

FOREIGN PATENT DOCUMENTS

| | | | |
|---|---|---|---|
| 2420182 | 11/1974 | Fed. Rep. of Germany | 34/99 |
| 3304165 | 8/1984 | Fed. Rep. of Germany . | |
| 568130 | 10/1957 | Italy | 34/99 |

*Primary Examiner*—Albert J. Makay
*Assistant Examiner*—David W. Westphal
*Attorney, Agent, or Firm*—Peter K. Kontler

[57] ABSTRACT

An electric hair dryer wherein a collapsible hood defines one or more plenum chambers for heated air and has a foraminous inner panel which is adjacent to the hair when the hood is placed over the head of the wearer. The hood has a hollow extension which is adjacent to the chest of the wearer and is separably connectable with the slotted detachable cover of a housing for the electric motor which drives a rotor for supplying heated air into the plenum chamber or chambers. The rotor is installed in the cover and is disposed downstream of an air heating unit which is mounted in the interior of a hollow cylindrical or frustoconical air guide and surrounds a tube for admission of cool atmospheric air into the space around the motor. The bottom wall, the front wall and the two lateral walls of the housing are formed with ports which admit atmospheric air into the air guide as well as into the tube.

41 Claims, 11 Drawing Figures

ELECTRIC HAIR DRYER WITH AIR DISPERSING HOOD

BACKGROUND OF THE INVENTION

The present invention relates to electric hair dryers in general, and more particularly to improvements in hair dryers of the type wherein streamlets of air are directed against the hair on the head of a person by a deformable hood which is placed onto and actually floats adjacent to the hair when the dryer is in use.

Hair dryers of the above outlined character employ a deformable and collapsible hood with a deformable outer panel which is impermeable to air and a deformable foraminous inner panel which is adjacent to the hair of the wearer of the hood and is surrounded by a plenum chamber receiving heated air from an air supplying apparatus including an electrically operated blower and an electrically operated air heating unit. As a rule, the housing of the blower is separably coupled to an extension of the hood so that it is adjacent to the chest of the wearer of the hood. The extension has two sections which extend along the sides of the face of the wearer and merge into each other at a level below the chin. The blower draws atmospheric air through slots which are provided in its bottom wall.

A hair dryer wherein the blower is suspended on an extension of the hood exhibits the advantage that the weight of the blower maintains the hood in an optimum position on the head of the wearer, not only in actual use but also prior to start or subsequent to completion of treatment with heated air. The blower can be said to constitute a weight which is adjacent to the chest so that its controls are within easy reach and that it obviates the need for any specially designed means for balancing the hood on the head of the wearer. Moreover, the wearer can readily reach the coupling which separably secures the housing of the blower to the extension of the hood. The coupling and the controls of the blower can be seen in a mirror which further simplifies the manipulation of such devices.

Atmospheric air which is drawn into and heated in the housing of the blower is forced into the plenum chamber and is divided into numerous streamlets which penetrate through the pores, interstices and/or holes of the inner panel on their way toward impingement upon the hair. The dimensions and configuration of the inner panel can be selected in such a way that the dryer can rapidly and uniformly or substantially uniformly condition the hair at the top, at the sides and in the back of the head wearing the hood.

A drawback of the aforedescribed hair dryer with a floating hood is that its capacity to contact the hair with heated air is limited by the relatively small combined cross-sectional area of the air-admitting slots in the bottom wall of the housing of the blower. It happens again and again that the admission of air by way of such slots is obstructed, either in part or entirely, by the garments of the wearer of the hood and/or by an object which is held in front of the chest at a level below the bottom wall of the housing. Lightweight garments (such as blouses, scarves or underwear) are likely to be attracted to the bottom wall of the housing by suction when the motor of the blower is on. This results in rapid overheating of the motor and pf the entire blower and reduces the efficiency of or totally interrupts the hair conditioning action. The accumulation of heat can be so pronounced that it can entail injury or discomfort to the user as well as damage to component parts of the hair dryer.

A further drawback of the above described conventional hair dryer is that, especially if the blower comprises a rapidly rotating impeller, it is likely to create draft which is felt by a relatively small part of the head and is highly unpleasant to the wearer of the hood, especially when the dryer is used for a relatively long interval of time. The development of draft is attributable primarily to the fact that the interior of the housing receives atmospheric air only from a relatively small part of the surrounding atmosphere, namely only by way of the slots in the bottom wall of the housing.

OBJECTS AND SUMMARY OF THE INVENTION

An object of the invention is to provide a novel and improved hair dryer which exhibits all advantages but avoids the aforeenumerated drawbacks of conventional hair dryers with floating hoods.

Another object of the invention is to provide a novel and improved apparatus which can be used to force heated or unheated air into the plenum chamber or chambers of the hood in the above outlined hair dryer.

A further object of the invention is to provide a hair dryer which is unlikely to be overheated and/or to create draft and which can supply adequate quantities of heated or unheated air for any desired practical interval of time.

An additional object of the invention is to provide a novel and improved housing for use in the air supplying apparatus of the above outlined hair dryer.

Still another object of the invention is to provide the air supplying apparatus with a housing whose air admitting openings are highly unlikely to be appreciably clogged or obstructed by garments or in any other way when the hair dryer is in use.

An additional object of the invention is to provide a hair dryer which can be readily manipulated by persons of all age groups and both sexes, either by professionals or by actual users, and whose useful life (especially in view of effective prevention of overheating of its air supplying apparatus) is longer than that of heretofore known hair dryers with floating hoods.

One feature of the invention resides in the provision of a hair dryer which comprises a hood defining at least one plenum chamber and having a deformable foraminous panel which is adjacent to the chamber and at least partially surrounds the hair on the head of a person wearing the hood so that streamlets of air which flow from the plenum chamber by way of the pores, interstices or holes in the panel condition the hair (such conditioning can involve heating or cooling, normally heating). The improved hair dryer further comprises an apparatus for supplying air into the plenum chamber, and such apparatus includes a hollow housing having a plurality of mutually inclined walls including at least two apertured walls which are provided with ports for admission of atmospheric air into the interior of the housing, means (preferably including an electric motor and a rotor which is driven by the motor) for conveying the thus admitted air into the plenum chamber, and means (e.g., an electric air heating unit) for influencing the temperature of air in the interior of the housing.

The hood of the hair dryer preferably further includes at least one hollow extension which is located at a level below the head of the person wearing the hood, and such hair dryer preferably further comprises means for separably coupling the housing to the extension so that the housing can be suspended on the hood, and guide means provided in the housing and serving to direct admitted air to the conveying means.

The walls of the housing (which can be assembled of several separable sections) further include an additional wall which is adjacent to the body of the person wearing the hood when the housing is coupled to the extension and which may but need not have any ports. Such additional wall can lie against the garment in front of the chest of the person wearing the hood. The apertured walls preferably include a front wall which is located opposite the additional wall, two lateral walls which flank the additional wall and the front wall, and a bottom or end wall which is remote from the air conveying means. At least some of the ports can have a substantially circular shape.

The guide means can comprise at least one hollow member in the form of a cylinder or a conical frustum. Alternatively, the guide means can comprise a plurality of sleeve-like members and means (e.g., distancing elements in the form of webs or ribs) for securing the sleeve-like members to each other. The sleeve-like members together define a passage for the flow of air from the ports to the conveying means and they preferably further define at least one slot which communicates with the passage. The slot is preferably a substantially circular gap between two neighboring sleeve-like members. The sleeve-like members can have different inner diameters and the sleeve-like member with the smallest inner diameter is preferably adjacent to but spaced apart from the inner side of the aforementioned bottom wall of the housing. The sleeve-like members preferably define a plurality of substantially annular slots for admission of atmospheric air from the neighboring ports of the housing into the passage. Alternatively, the sleeve-like members can have at least substantially identical inner diameters and are preferably spaced apart from each other do define a plurality of substantially annular slots.

The air conveying means including the motor and the rotor is preferably located downstream of the temperature influencing means, as considered in the direction of air flow from the ports into the plenum chamber of the hood. The motor and the temperature influencing means are preferably installed in a main portion of the housing, and the rotor is preferably installed outside of such main portion and is preferably confined in the extension of the hood when the housing is properly coupled to the extension. The housing preferably further includes an apertured closure or cover which surrounds the rotor and is also located in the extension when the latter is coupled to the housing. Such closure can comprise a top wall, a collar (e.g., a one-piece annular body or a composite body consisting of several discrete prongs) which is remote from the top wall, and ribs which extend between the top wall and the collar and define a plurality of passages (e.g., elongated slots which extend in substantial parallelism with the axis of the rotor) for the flow of air from the rotor into the plenum chamber. The ribs are or can be disposed in planes which are at least slightly inclined with reference to the axis of the rotor. Portions of the passages can extend into the top wall of the closure; alternatively, the top wall can be provided with additional passages (e.g., in the form of slots which extend radially of the rotor) for the flow of air from the rotor into the plenum chamber. The top wall of the closure can comprise an impermeable recessed median portion which is closely adjacent to the hub of the rotor.

The heating unit of the temperature influencing means is preferably installed in the passage which is defined by the guide means.

The preferably one-piece synthetic plastic bearing for the rotor of the air conveying means is installed in the housing and preferably includes a radially outermost portion which is secured to the main portion of the housing, a tubular member (e.g., a cylinder) which defines with the casing of the motor an annular clearance, and plates in the form of substantially radially extending bridges which connect the radially outermost portion with the cylinder and define a number of large paths for the flow of heated air from the heating unit into the range of the rotor. The cylinder can comprise a closing member which is disposed between the motor and the rotor and through which the output element of the motor extends to drive the rotor. The closing member can have several apertures one of which receives the output element of the motor.

The means for cooling the motor of the air conveying means can comprise a tubular cooling element which serves to convey cool (unheated) atmospheric air from certain ports in the bottom wall of the housing into the aforementioned annular clearance between the cylinder of the bearing and the casing of the motor. The intake end of the cooling element can be placed rather close to the inner side of the bottom wall.

The cooling member is preferably installed in the interior of and is spacedly surrounded by the guide means. The rotor can comprise a first set of vanes (e.g., in the form of small projections at that side of the hub of the rotor which faces the motor) which serve to draw air from the cooling element toward and past the casing of the motor, and a second set of vanes which serve to draw heated air through the guide means and to propel such air into the plenum chamber of the hood. The insulating supports for the electrically heatable wire or wires of the heating unit which constitutes or forms part of the temperature influencing means are preferably mounted at the exterior of the cooling element and within the confines of the guide means.

The rotor can constitute a one-piece part which is preferably made of a synthetic plastic material and whose hub is integral with the first set of vanes. The second set of vanes preferably extends between an annular rim and an intermediate portion of the rotor; such intermediate portion surrounds the hub of the rotor.

Another feature of the invention resides in the provision of an air supplying apparatus which can be used with particular advantage in a hair dryer of the type having the aforediscussed hood. The apparatus comprises a hollow housing having a plurality of air admitting ports, an electric motor in the housing, a rotor which is driven by the motor and serves to draw air into the housing by way of the ports, and an air heating unit which is installed in the housing upstream of the rotor as considered in the direction of air flow from the ports to the rotor. As mentioned above, the housing comprises a plurality of walls and the ports are provided in two or more walls of the housing to ensure that the ports in one or more walls can admit air even if the flow of air through the ports of one or more walls is temporarily obstructed.

The novel features which are considered as characteristic of the invention are set forth in particular in the appended claims. The improved hair dryer itself, however, both as to its construction and the mode of assembling and using the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
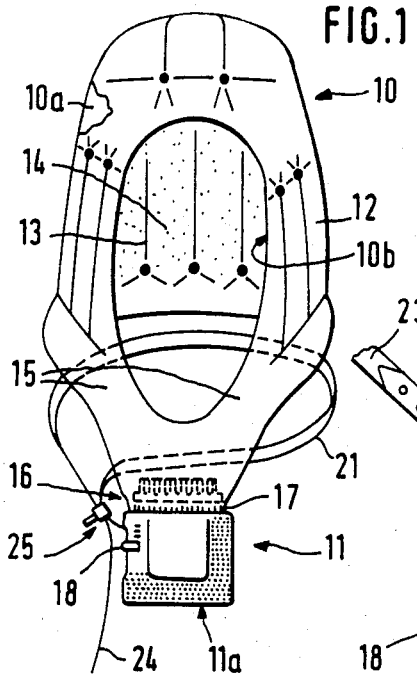
FIG. 1 is a somewhat schematic front elevational view of an electric hair dryer which embodies one form of the invention and wherein the housing of the air supplying apparatus is separably coupled with a one-piece extension of the hood and with one end portion of a strap.

The drawing shows only those component parts of the improved electric hair dryer which are necessary for a full understanding of the invention. The hair dryer can employ a conventional cable for connection to a suitable source of electrical energy, one or more conventional switches and a conventional motor for transmission of torque to the rotor which forms part of the means for conveying air from a housing 11*a* into the plenum chamber or chambers 10*a* of a deformable and collapsible hood 10. Therefore, such conventional parts are not shown at all or are shown only schematically. For example, the hair dryer can employ a 2-step or a 3-step switch and an electric motor which can be operated at 110 or 220 volts. Furthermore, the hair dryer can be equipped with means for selecting any one of two or more air flow settings. All such features are well known in the art, for example, from Models Nos. 462, 466 and 467 which are manufactured and distributed by the assignee of the present application.

FIG. 1 shows schematically a hair dryer which comprises the deformable and collapsible hood 10, an apparatus 11 for supplying air into the plenum chamber or chambers 10*a* of the hood 10, a strap 21 which can be used to suspend the apparatus 11 on the body of the person wearing the hood 10, and a coupling device 16 which is used to separably connect a one-piece extension 15 of the hood 10 with the housing 11*a* of the apparatus 11 so that the latter can be suspended on the hood in a position at a level below the head of the person using the hair dryer.

The hood 10 comprises a plurality of flexible panels including an outer panel 12 and an inner panel 13. These panels can be folded or otherwise collapsed into a very small package which can be confined in a suitable carrying case. The latter is preferably designed to further confine the apparatus 11, the strap 21 and the cable (not shown) which connects the electric motor 40 in the interior of the apparatus 11 with a household outlet or another suitable source of electrical energy.

The inner panel 13 of the hood 10 is foraminous so that it permits streamlets of air (normally heated air) to pass through its perforations or pores 14 and to condition the hair on the head of the person wearing the hood. The underside of the hood 10 is open so that it can be slipped onto the head not unlike a helmet or a ski mask. When the hood 10 is inflated in response to admission of air into its plenum chamber or chambers 10*a*, the panels 12, 13 actually float on the head of the wearer and ensure a highly predictable and uniform conditioning of hair. The opening 10*b* in the front part of the hood 10 is sufficiently large to expose the entire face of the Wearer irrespective of whether or not the hood is inflated. The extension 15 surrounds a portion of the opening 10*b* and extends along the sides of the jaws and below the chin of the wearer toward the central portion of the chest where it is attached to the housing 11*a* of the apparatus 11 by the aforementioned coupling device 16. The plenum chamber or chambers 10*a* extend into the extension 15; such chamber or chambers are further provided in those portions of the hood 10 which are adjacent to the hair on the head of the wearer. If the hood 10 is formed with two or more separate chambers 10*a*, such chambers can be partially or fully separated from each other by vertically or otherwise extending rows of stitches or by strips of adhesive.

The lowermost portion of the extension 15 includes the female element 17 of the coupling device 16 and the complementary male coupling element 16*a* is provided on the top portion of the housing 11*a*. The female coupling element 17 is a ring of elastomeric material which can be slipped into a circumferential groove 16*c* of the male coupling element 16*a* beneath a flange or collar 16*b*. This quick-release device 16 is but one of many coupling devices which can be used to establish a readily separable but reliable connection between the hood 10 and the air supplying apparatus 11 so that these two main constituents of the improved hair dryer can be rapidly separated from each other for the purpose of storing them in the aforementioned carrying case. The coupling device 16 is sufficiently strong to ensure that the housing 11*a* remains suspended on the extension 15 when the ring 17 is received in the groove 16*c* of the male coupling element 16*a* so that the wearer of the hood 10 need not support the housing 11*a*. The ring 17 can be permanently installed in or it can be detachably secured to the extension 15. The position of the ring 17 is preferably selected in such a way that, when the hair dryer is in use, the housing 11*a* is located immediately below or close to the chin so that the likelihood of dangling of the apparatus 11 back and forth is reduced to a minimum. The housing 11*a* descends to a level below its normal level when the chamber or chambers 10*a* of the hood 10 cease to receive air from the apparatus 11.

The illustrated one-piece extension 15 of the hood 10 can be replaced With a pair of discrete extensions each of which includes a male or female coupling element connectable to the coupling element of the other discrete extension and/or directly to the housing 11*a*. This embodiment is not specifically shown in the drawing because it constitutes a rather simple modification of the illustrated hood 10 and its extension 15. The housing of the apparatus 11 can be provided with a single coupling element for engagement with the coupling elements of two discrete extensions or with a pair of coupling elements, one for each of two discrete coupling elements on the extensions.

Figure 2:
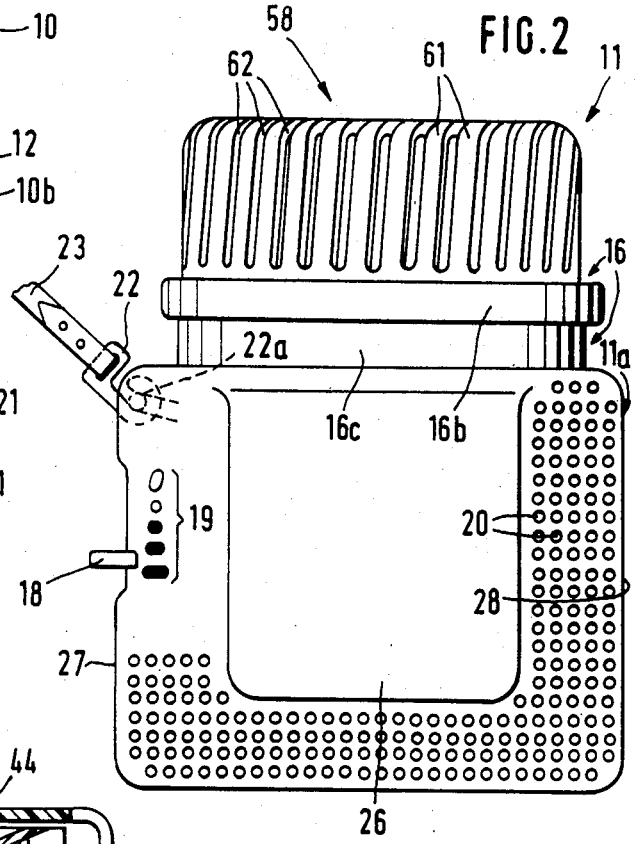
FIG. 2 is an enlarged front elevational view of the air supplying apparatus.

FIGS. 1 and 2 show the manually displaceable portion of a selector 18 which projects from the lateral wall 27 of the housing 11*a* and is movable between several positions into register with a selected one of several indicia 19 at the exposed side of the front or outer wall 26 of the housing 11*a*. The selector 18 extends into the internal compartment 33 of the housing 11*a* and can be used to select the rate of flow of air into the hood 10 (e.g., at 10.5 or 16 liters per second), to start the motor 40 or to arrest the motor. The color of the exposed portion of the selector 18 may be different from the color of the housing 10*a* so as to enable the user to rapidly locate the selector, e.g., by looking into the mirror in a beauty salon.

FIGS. 1 and 2 further show that the strap 21 is separably attached to the housing 11*a* at a level above the displaceable portion of the selector 18, i.e., at the upper end of the lateral wall 27. When the hair dryer is in use, the strap 21 forms a loop which surrounds the neck and is in contact with the nape of the wearer of the hood 10. The length of the loop which is formed by the strap 21 is preferably selected in such a way that at least a substantial part of the weight of the apparatus 11 is carried by the strap, i.e., by the nape of the wearer. The reference character 25 denotes a conventional length adjusting device which enables the user or an attendant in a beauty salon to change the length of the loop which is defined by the strap so that the hair dryer can be properly applied to persons of all age groups and sizes. One end portion 23 of the strap 21 is connected with a hook 22 which releasably engages a pin 22*a* on the rear or inner wall 26*a* of the housing 11*a*. The hook 22 can engage the pin 22*a* by snap action due to at least slight elasticity of the material of the hook. The tip of the end portion 23 is bent over itself and extends through a slot of the hook 22. Rivets or other suitable fasteners are provided to permanently or separably secure the end portion 23 to the hook 22. The pin 22*a* can be provided with or replaced by a second hook which is complementary to and can be separably engaged by the hook 22. Other types of connections between the strap 21 and the housing 11*a* can be used with equal or similar advantage.

The other end portion 24 of the strap 21 is slidable, with requisite friction, in an eyelet of the adjusting device 25 so as to enable the user to change the length of the loop which surrounds the neck of the wearer of the hood 10. The eyelet of the adjusting device 25 fixedly or longitudinally movably surrounds the end portion 23, i.e., the distance between the adjusting device 25 and the eyelet may but need not be variable. This adjusting device is of conventional design; for example, it can be of the type often used on straps for the cases of photographic apparatus, binoculars or the like. In one of its presently preferred forms, the entire adjusting device 25 can consist of a single plate-like member having two transverse slots for the end portions 23, 24 and being sufficiently stiff to frictionally hold the end portions against longitudinal movement relative to each other and/or relative to the adjusting device until and unless the end portion 24 is intentionally pulled in a direction to increase or reduce the size of the loop. Reference may be had to commonly owned German Utility Model No. 8 420 202. Alternatively, the plate-like member can extend laterally beyond the adjacent portions of the strap and can be provided with an opening for the clamping eyelet of a pushbutton, not shown.

A modified adjusting device can be integrated into the housing 11*a* and can be actuated to permit or to prevent changes in the size of the loop which is defined by the strap 21. Such modified adjusting device can be installed in a discrete chamber of the housing 11*a* of the apparatus 11 or in the compartment 33. Reference may be had to the commonly owned German Offenlegungsschrift No. 33 04 165.

As can be readily seen in FIG. 7, the end wall or bottom wall 29 (i.e., that wall which is remotest from the coupling device 16 at the top of the apparatus 11) of the housin 11*a* is formed with a plurality of circular openings 20 (hereinafter called ports) which admit atmospheric air into the compartment 33 of the housing 11*a*. In heretofore known hair dryers which employ a collapsible hood, the openings or ports of the bottom wall are the only openings which admit atmospheric air into the interior of the housing. The provision of air admitting ports in the bottom wall 29 of the housing 11*a* is desirable and advantageous because such ports are unlikely to be obstructed when the housing 11*a* is suspended on the strap 21 and on the extension 15 and is located immediately adjacent or at a level close to but invariably below the head of the wearer of the hood. In many presently-known hair dryers of the type to which the hair dryer of the present invention belongs, the bottom wall of the housing is formed with a relatively small number of ports (e.g., ten) in the form of elongated parallel slots having different cross-sectional areas and extending transversely of the bottom wall, i.e., toward or away from the chest of the wearer of the hood.

In accordance with a feature of the present invention, the housing 11*a* includes at least two and preferably more than two walls which are formed with air admitting ports. In the embodiment which is shown in FIGS. 1 to 7, ports 20 are provided in the front wall 26, in the bottom wall 29, in the aforementioned lateral wall 27 and in the other lateral wall 28 of the housing 11*a*. The latter is a substantially block-shaped hollow member with certain of its walls rounded or otherwise shaped to allow for convenient grasping by one hand. The ports 20 in the front wall 26 can be readily seen in FIG. 2, the ports 20 in the bottom wall 29 can be seen in FIGS. 3 and 7, the ports 20 in the lateral wall 27 can be seen in FIGS. 3 and 5, and the ports 20 in the lateral wall 28 can be seen in FIGS. 3 and 6. While the draWing shows ports 20 which have a substantially circular outline, it is equally possible to provide the housing 11*a* with slot-shaped or polygonal ports without departing from the spirit of the invention. Furthermore, the housing 11*a* can be provided with two or more sets of ports having different shapes and/or sizes, and the shapes and/or sizes of all ports in any particular apertured wall of the housing 11*a* may but need not be the same.

Still further, and as can be readily seen in FIGS. 1 to 3 and 5 to 7, the ports 20 can be uniformly distributed in an entire wall or in one or more selected portions of a particular wall of the housing 11*a*. The distribution of ports 20 is preferably uniform in order to enhance the appearance of the housing 11*a* and to allow for more uniform distribution of the regions where atmospheric air can enter the compartment 33; however, such uniformity is not necessary. The rear wall 26*a* of the housing 11*a* is not provided with ports because it normally contacts the garment of the wearer of the hood 10 so that such garment would or could interfere with the admission of streamlets of air into the compartment 33. The number and size of the ports 20 can be increased practically at will, as long as the housing 11*a* can still stand the thermally induced and/or other stresses which are anticipated when the apparatus 11 is in actual use.

Figure 5:
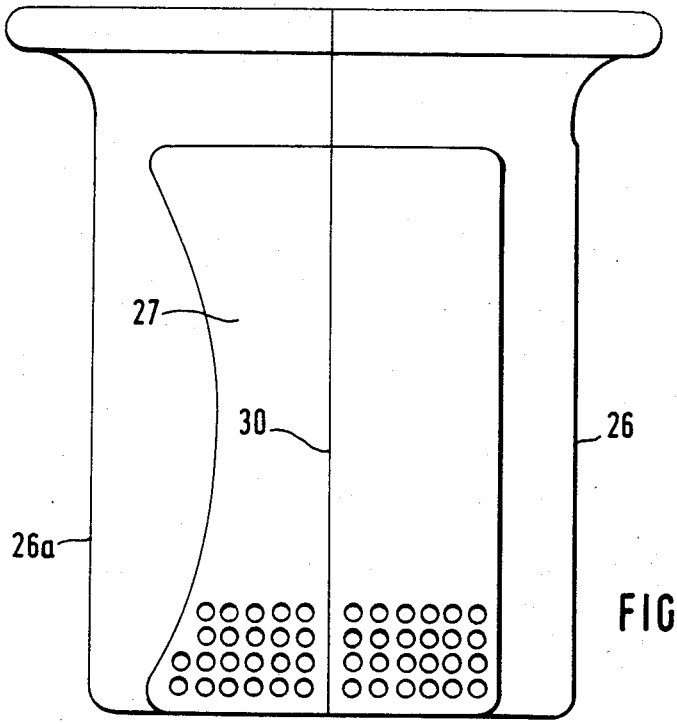
FIG. 5 is an enlarged side elevational view of the housing of the air supplying apparatus, as seen from the left-hand side of FIG. 2 or 3, with the selector and the means for separably securing the strap to the housing omitted.
Figure 6:
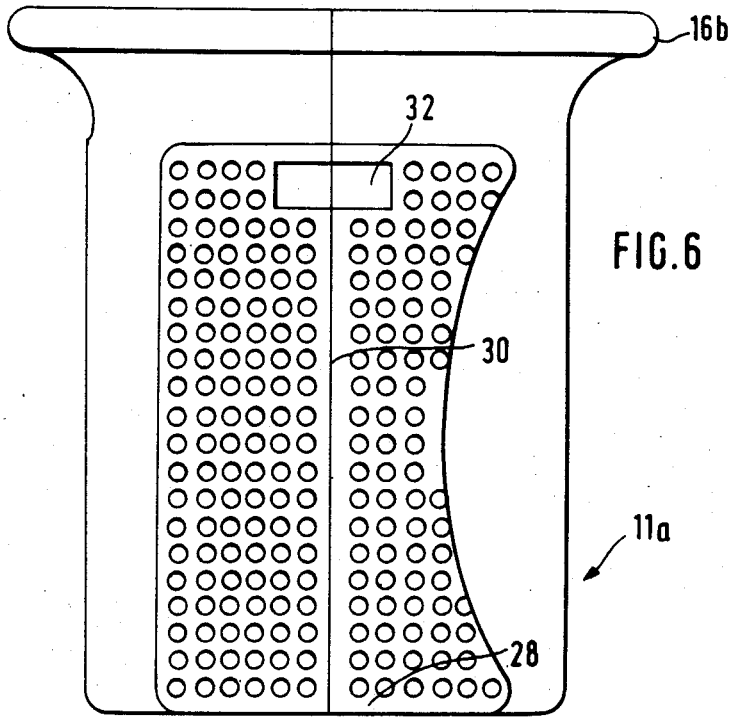
FIG. 6 is an enlarged side elevational view of the housing as seen from the right-hand side of FIG. 2 or 3.
Figure 7:
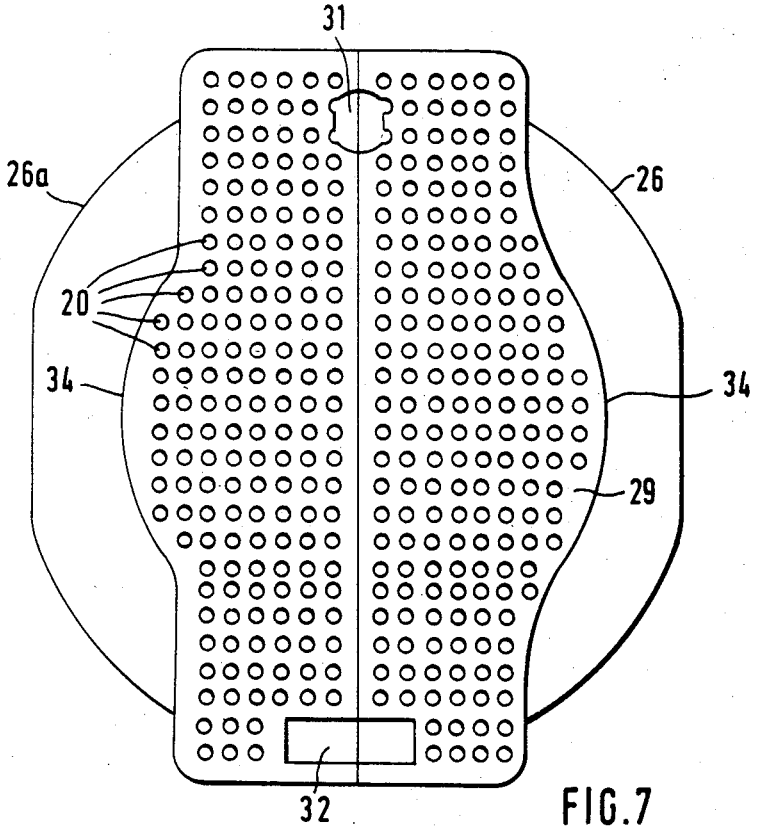
FIG. 7 is an enlarged bottom plan view of the housing which is shown in FIGS. 1 to 3 and 5–6.

FIGS. 5, 6 and 7 show that the housing 11*a* is assembled of two substantially but not necessarily mirror symmetrical sections or halves which can be separably or more or less permanently secured to each other to define the compartment 33 and to confine the air conveying means, the guide means and/or other components (such as the aforediscussed modified adjusting device for the strap 21). The plane in which the sections or halves of the housing 11*a* abut against each other is denoted by the reference character 30. The two sections can be provided with cooperating male and female detent means (not specifically shown) which allow for rapid assembly of the two sections into a housing 11*a* and/or rapid separation of the two sections from one another, e.g., in response to exertion of a certain pull or in response to the insertion and twisting of a screwdriver or a like tool between the two sections.

FIG. 7 shows that the bottom wall 29 of the housing 11*a* is provided with a relatively large opening 31 which serves to allow for introduction of the aforementioned electric cable into the interior of the housing. The conductor means in the cable connects the switch or switches of the selector 18 and the motor 40 in circuit with an external energy source. The slot for the outwardly extending portion of the selector 18 is not shown in FIG. 7. A rectangular slot 32 in the bottom wall 29 or in the lateral wall 28 is provided to allow for insertion of a portion of the strap 21 if the aforediscussed modified adjusting device is installed in the compartment 33 or in another chamber or compartment in the interior of the housing 11*a*.

Figure 3:
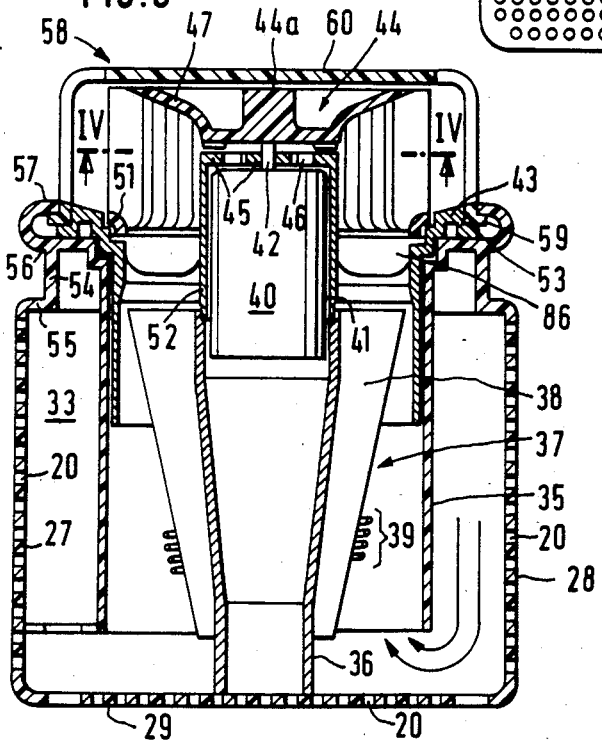
FIG. 3 is a central vertical sectional view of the air supplying apparatus.
Figure 4:
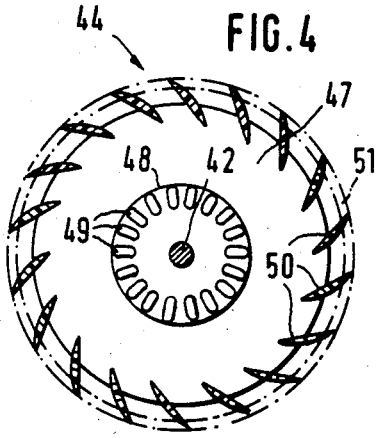
FIG. 4 is a sectional view of the rotor as seen in the direction of arrows from the line IV—IV of FIG. 3.

The housing 11*a* contains guide means for directing admitted atmospheric air to the means for conveying streamlets of air into the chamber or chambers 10*a* of the hood 10. FIG. 3 shows a first form of guide means including a hollow cylindrical member 35 whose open intake end is adjacent to but spaced from and faces the inner side of the bottom wall 29 and whose cylindrical body is spacedly surrounded by the walls 26, 26*a*, 27 and 28. The cylindrical member 35 is assembled of two halves which are integral with the corresponding sections of the two-piece housing 11*a*. The arrows in the lower portion of FIG. 3 indicate the direction of flow of atmospheric air which enters the compartment 33 via ports 20 in the walls 26, 27 and 28 and enters the open lower end of the guide means 35. The streams which enter via ports 20 of the bottom wall 29 flow directly into the guide means 35 without any or with negligible deflection. The outer diameter of the guide means 35 can exceed the width of the narrowest portions of the bottom wall 29 (see FIG. 7). Therefore, the width of the median portion of the bottom wall 29 preferably exceeds the width of its end portions (this is shown in FIG. 7 at 34) and the corresponding portion of the wall 26 bulges outwardly so as to ensure that a portion of the compartment 33 extends between the inner side of the wall 26 and the adjacent portion of the guide means 35, i.e., that the streams of atmospheric air which enter the compartment 33 via ports 20 in the wall 26 can flow toward the intake end of the guide means 35.

The hollow cylindrical guide means 35 can be replaced with guide means in the form of a hollow conical frustum without departing from the spirit of the invention. The guide means 35, or its frustoconical equivalent, replaces conventional guides which are made of wire in a separate operation and must be installed in the interior of the housing of a conventional air supplying apparatus at a considerable initial cost. The open intake end of the guide means 35 is sufficiently large and sufficiently distant from the inner side of the bottom wall 29 to ensure that atmospheric air entering the compartment 33 from all of the ports 20 can flow into the passage which is defined by the guide means 35, either directly or after requisite deflection in the region of the bottom wall 29.

Figure 8:
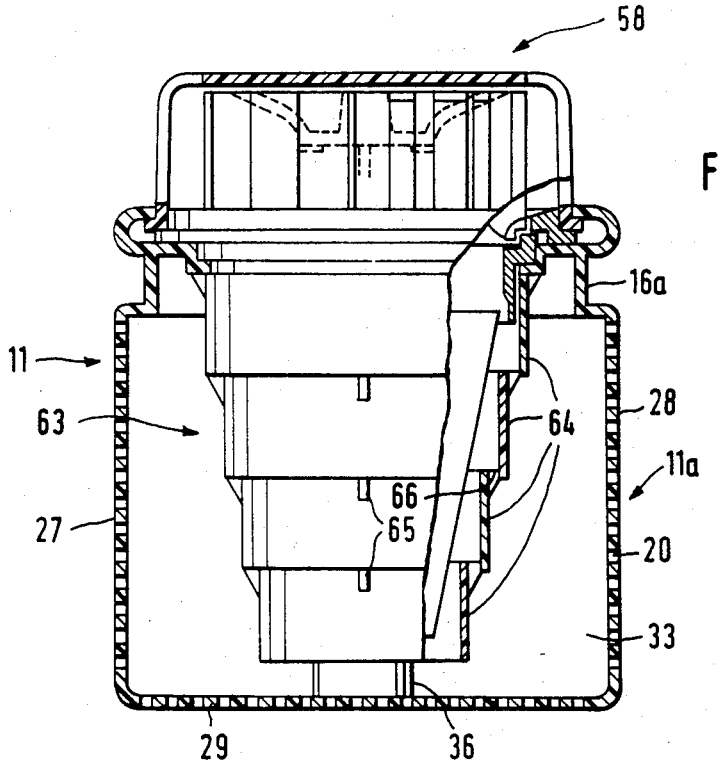
FIG. 8 is a central vertical sectional view of a second air supplying apparatus with modified guide means for ensuring the flow of atmospheric air past the heating unit and into the range of the rotor.

FIG. 8 shows an air supplying apparatus 11 whose housing 11*a* confines a modified guide means 63 for atmospheric air which is admitted via ports in two or more walls of the housing 11*a*. The guide means 63 comprises several sleeve-like members 64 in the form of relatively short hollow cylinders having different diameters and being connected to each other by a plurality of radially extending distancing elements in the form of webs or ribs 65. The neighboring members 64 are partially telescoped into each other and define annular slots 66 which are interrupted by the corresponding sets of webs 65. The members 64 together define an elongated passage whose diameter increases in a direction away from the bottom wall 29 of the housing 11*a* and which communicates with the surrounding compartment 33 by way of the open intake end of the guide means 63 as well as by way of the annular slots 66. The smallest-diameter sleeve-like member 64 is nearest to the bottom wall 29 and the largest-diameter member 64 is nearest to the male coupling element 16*a* at the top end of the housing 11*a*. It is clear that the neighboring sleeve-like members 64 need not be exactly concentric with each other. An important advantage of the slots 66 is that they allow atmospheric air which enters the compartment by way of adjacent ports 20 in the front wall (not shown) as well as in the lateral walls 27, 28 of the housing 11*a* to enter the passage of the guide means 63 without the need for deflection toward the fully open intake end of the guide means.

The sleeve-like members 64 can be said to constitute a substantially frustoconical body whose smaller-diameter end is adjacent to the inner side of the bottom wall 29 and whose larger-diameter end is adjacent to the top wall of the housing 11*a*.

Figure 9:
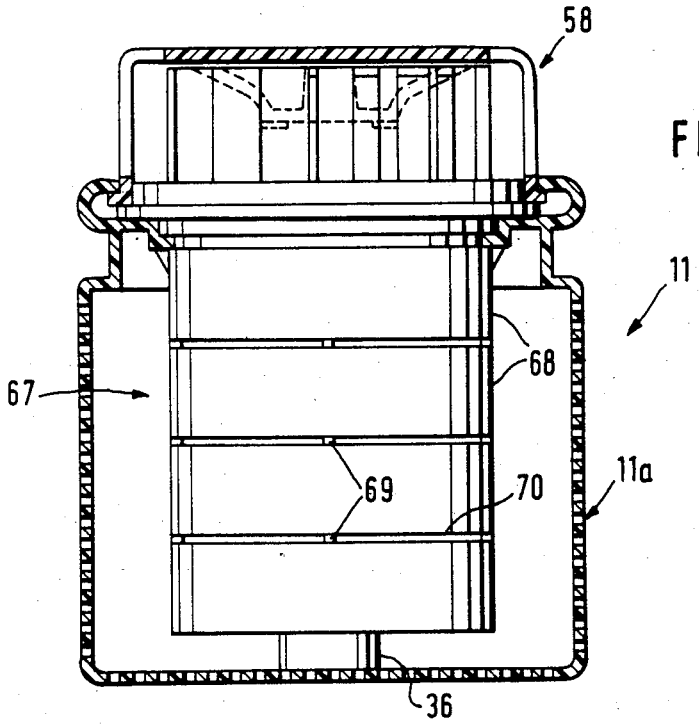
FIG. 9 is a similar central vertical sectional view of a third air supplying apparatus with composite cylindrical air guide means.

Referring to FIG. 9, there is shown a further apparatus 11 whose housing 11*a* spacedly surrounds a modified guide means 67 assembled of several coaxial sleeve-like members 68 having identical inner and outer diameters and being secured to each other by distancing elements in the form of webs or ribs 69 so as to define substantially annular slots 70 serving the same purpose as the slots 66 of the guide means 63 shown in FIG. 8.

The guide means 63 or 67 can be modified by making it of a single cylindrical or conical piece of a suitable metallic or synthetic plastic material and providing such modified guide means with circumferentially and/or otherwise extending slots or cutouts serving the same purpose as the slots 66 and 70.

Each of the guide means 63 and 67 preferably consists of two identical halves which are integral with the respective sections of the housing 11*a*.

Regardless of the exact shape of the guide means, the housing 11*a* preferably contains a tubular cooling element 36 (see particularly FIG. 3) which is spacedly surrounded by the guide means 35, 63 or 67 and serves to admit cool or relatively cool atmospheric air directly to the motor 40 so that the latter is not overheated even if the hair dryer is in use for an extended period of time. The median portion of the cooling element 36 can constitute the frustum of a hollow cone whose end portions are integral with two cylindrical portions, one adjacent to the bottom wall 29 and the other adjacent to the motor 40. The larger-diameter end portion of the tubular cooling element 36 is integral with or is separably or permanently connected to a cylinder 52 which spacedly surrounds the casing of the motor 40 so that such casing and the internal surface of the cylinder 52 define an annular clearance 41. The cylinder 52 preferably forms part of an annular bearing 43 for the rotor or impeller 44 of the means for conveying air into the plenum chamber or chambers 10*a* of the hood 10. The rotary output element 42 of the motor 40 is connected with and drives the rotor 44 which is adjacent to the inner side of the top wall 60 of a cupped closure or cover 58; the latter constitutes a detachable part of the housing 10*a*.

The tubular cooling element 36 preferably performs an additional function, namely that of carrying a set of radially extending wedge-like insulating supports 38 for the coiled wire or wires 39 of the air heating unit 37 in the interior of the housing 11*a*. The air heating unit 37 is installed in the interior of the guide means 35 so as to change the temperature of atmospheric air which flows into the range of the rotor 44. The cooling element 36 can be provided with axially parallel external grooves or slots for reception and retention of the radially innermost portions of the insulating supports 38. The selector 18 can be designed to determine that number of convolutions of the wire 39 which are connected between the poles of the energy source, i.e., to determine the extent to which the stream of atmospheric air flowing in the passage defined by the guide means 35 is heated on its way toward the rotor 44. The exact nature of the means for regulating the heating action of the unit 37 forms no part of the present invention.

The cooling member 36 is preferably straight or substantially straight so as to ensure that atmospheric air which is to cool the motor 40 reaches the casing of the motor after flowing along a relatively short path, preferably from the ports 20 of the bottom wall 29 and straight to the clearance 41 around the casing of the motor. The cooling member 36 is preferably concentric with the guide means 35, 63 or 67.

The utilization of the cooling member 36 as a means for carrying the insulating elements 38 of the heating unit 37 renders it possible to dispense with a discrete carrier for the insulating supports 38 and wire or wires 39.

The bearing 43 is preferably made of a single piece of a suitable electrically insulating material and serves to carry the casing of the motor 40. The radially outermost portion 53 of the bearing 43 includes a tubular component 53*a* which extends into and is closely adjacent to the internal surface of the guide means 35 in the region radially inwardly of the coupling element 16*a*. The tubular component 53*a* is rigid with radially inwardly extending connecting members in the form of narrow reinforcing or stiffening bridges 86 which are integral with the cylinder 52 and define a number of large paths for the flow of heated air toward the rotor 44. As mentioned above, the cylinder 52 spacedly surrounds the casing of the motor 40 to define the aforementioned clearance 41.

The upper end portion of the cylinder 52 (as viewed in FIG. 3) is closed by a plate-like closing member 45 having apertures 46 one of which receives a portion of the output element 42. The remaining apertures 46 serve to admit heated air, which has passed through the clearance 41, into the range of the rotor 44.

The rotor 44 of the air supplying apparatus 11 which is shown in FIGS. 1 to 3 is a one-piece wheel which is preferably made of a suitable synthetic plastic material and includes a solid hub 44*a* which is affixed to the output element 42 of the motor 40. The hub 44*a* is provided with an annulus of projections 49 (see FIG. 4) adjacent to the radially innermost part 48 of an outwardly and upwardly diverging intermediate portion 47 of the rotor 44. The projections 49 can be said to constitute vanes which draw air from the interior of the cooling element 36, through the clearance 41 and through the apertures 46 of the closing member 45 when the motor 40 is on. The rotor 44 further comprises a second annulus of vanes or blades 50 which are connected with the intermediate portion 47 as well as with a ring-shaped rim 51 (see FIGS. 3 and 4). The blades 50 are inclined with reference to planes extending radially of the rotor 44 and are equidistant from each other, as considered in the circumferential direction of the rotor.

The dimensions of the projections 49 which draw spent air from the clearance 41 can be a small fraction of the dimensions of the blades 50 which draw heated air from the range of the heating unit 37 into the interior of the cover 58 for penetration into the chamber or chambers 10*a* of the hood 10. The projections 49 preferably constitute integral parts of the rotor 44.

The motor 40 and the rotor 44 together constitute a means for conveying normally heated atmospheric air into the chamber or chambers 10*a* of the hood 10 as well as for drawing air through the cooling element 36, clearance 41 and apertures 46 in order to adequately cool the motor 40. The rotor 44 is located downstream of the heating unit 37, as considered in the direction of air flow from the ports 20 toward and into the chamber or chambers 10*a*. The upper end portion of the housing 11*a* is preferably large so that the housing can accommodate a large-diameter rotor 44 which can draw large quantities of air through the ports 20 for admission into the hood 10. The rotor 44 is or can be larger than in heretofore known apparatus.

The groove 16*c* of the coupling element 16*a* on the housing 11*a* surrounds a cylindrical portion 54 of the housing and is flanked by two washer-like portions 55, 56 which are integral with the housing 11*a* and are disposed at the two axial ends of the portion 54. The portion 56 forms part of the flange or collar 16*b*. The surface which surrounds the groove 16*c* has a substantially U-shaped cross-sectional outline. Such outline is particularly suitable for reliable retention of the elastomeric ring 17 which constitutes the female element of the coupling device 16.

The washer-like portion 56 of the flange 16*b* merges into an externally rounded portion 57 which serves to detachably hold the cup-shaped closure or cover 58 including the aforementioned top wall 60 at the adjacent axial end of the rotor 44. The means for separably attaching the closure 58 to the portion 57 of the flange 16*b* includes several outwardly extending legs or prongs 59 which are overlapped by the radially innermost part of the rounded portion 57 to ensure reliable retention of the closure 58 in the position which is shown in FIG. 3. The closure 58 preferably constitutes a one-piece part which is made of a suitable synthetic plastic material. The legs or prongs 59 are or can be at least slightly elastic so that they can be depressed preparatory to engagement with the rounded portion 57 of the flange 16*b*. If the legs or prongs 59 together constitute a rigid circumferentially complete collar, this collar is engaged with the rounded portion 57 as a result of connection of the two sections of the housing 11*a* to each other. The top wall 60 is connected with the legs 59 by an annulus of ribs or bars 61 (see particularly FIG. 2) which define slots 62 for admission of heated air from the housing 11*a* into the chamber or chambers 10*a* of the hood 10. As can be seen in FIG. 3, the upper end portions of the slots 62 preferably extend into the top wall 60. The ribs 61 are preferably disposed in planes which are inclined with reference to planes extending radially of the rotor 44, i.e., the planes of the ribs 61 do not or need not intersect the axis of the rotor. Uniform distribution of slots 62 all the way around the rotor 44 is desirable and advantageous because this ensures the admission of a large number of streams of hot air into the interior of the hood 10 to thus reduce the likelihood of draft. The chamber or chambers 10*a* extend into the extension 15 so that such chamber or chambers can receive hot air which leaves the housing 10*a* via slots 62. The entire closure 58 is confined in the extension 15 when the ring 17 is received in the groove 16*c* of the coupling element 16*a* on the housing 11*a*. The mounting of the closure 58 in the embodiments of FIGS. 8 and 9 is or can be identical with the mounting of the closure in the embodiment of FIGS. 1 to 3.

In heretofore known hair dryers, the rotor of the air conveying means is immediately or closely adjacent to the bottom wall of the housing, i.e., to that wall which is provided with air admitting slots. The heating unit of the air supplying apparatus in a conventional hair dryer is located downstream of the rotor, as considered in the direction of flow of air from the rotor toward and into the hood. Such mounting of the heating unit and of the rotor exhibits the drawback that the dimensions of the rotor are determined by the dimensions of the housing in the region of the bottom wall, i.e., in a region where the dimensions of the housing should be as small as possible, not only for convenience of manipulation but also for convenience of storing the housing in a relatively small and compact carrying case. The utilization of a relatively small rotor necessitates rotation of such rotor at a very high RPM which, in turn, results in the generation of excessive noise and increases the likelihood that lightweight portions of garments will be sucked against the outer side of the bottom wall to thus interfere with or to completely block the flow of atmospheric air into the interior of the housing.

The placing of the rotor 44 downstream of the heating unit 37 and its installation in the housing 11*a* at a location which is remote from the bottom wall 29 overcomes the aforediscussed drawbacks. The rather large rotor 44 is mounted in the large-diameter closure or cover 58 so that the rotor generates less noise because it need not be driven at an elevated speed. Such rotor further ensures a more uniform distribution of air in the chamber or chambers 10*a* of the hood 10.

The dimensions of the closure 58 can be selected independently of the dimensions of that portion of the housing 11*a* which accommodates the motor 40, the heating unit 37 and the guide means 35, 63 or 67. The same applies for the rotor 44 within the confines of the closure 58. This is possible because the rotor 44 is located downstream of the heating unit 37, as considered in the direction of flow of air into the hood 10. Since the closure 58 and the rotor 44 are confined in the extension 15 when the latter is properly coupled to the housing 11*a*, the slots 62 can extend all around the rotor to thereby ensure uniform admission of heated air into the chamber or chambers 10*a*. It will be seen that the dimensions of the closure 58 and rotor 44 can be selected independently of the dimensions of that (major) part of the housing 11*a* which confines the heating unit 37, the guide means 35, 63 or 67, the cooling element 36 and the motor 40, and vice versa. As mentioned above, this renders it possible to employ a rather large rotor which can be driven at a low RPM to reduce noise. Moreover, and since the exact dimensions of the rotor are not as important as in conventional hair dryers wherein the rotor is located upstream of the heating unit, the air supplying apparatus 11 can employ any of a wide variety of rotors which are not only acceptable but actually highly desirable as soon as the dimensions are not the most important factor which determines their usefulness or lack of usefulness in a hair dryer. The one-piece extension 15 provides ample room for confinement of the closure 58 and rotor 44 in such a way that the streamlets of heated air which issue from the interior of the closure 58 can flow directly into that portion or those portions of the chamber or chambers 10*a* which are defined by the extension. The main purpose of the relatively rigid closure 58 is to prevent direct contact between the rotor 44 and the deformable material of the extension 15 as well as to allow for predictable (preferably uniform) distribution of streamlets of heated air which flow into the interior of the extension all the way around the circumference of the rotor.

The dimensions of all slots 62 and of the intervening ribs 61 are preferably identical for convenience and simplicity of manufacture. However, the making of a closure with two or more sets of differently dimensioned and configurated ribs and/or two or more sets of differently dimensioned and/or configurated slots or analogous passages for the flow of heated air into the extension 15 is also possible. The utilization of ribs whose planes are inclined with reference to the axis of the rotor 44 and of slots which extend into the radially outermost portions of the top wall 60 has been found to ensure highly satisfactory distribution of hot air on its way into the interior of the extension 15. Thus, the interior of the extension 15 receives heated air which flows radially of the rotor 44 as well as in parallelism with the axis of the output element 42. It is equally possible to provide the peripheral portion of the closure 58 with slots which are parallel to the axis of the output element 42 and to provide the top wall 60 with additional slots which may but need not communicate with the slots in the peripheral portion of the closure and extend radially of the rotor 44.

The length of the heating unit 37, as considered in the axial direction of the cooling element 36, preferably equals or closely approximates the length of the guide means 35, 63 or 67. This is especially desirable and advantageous in the apparatus of FIGS. 8 and 9 because the heat-radiating wires of the unit 37 can properly heat the streams of atmospheric air which enter the passage of the guide means 63 or 67 by way of the respective slots 64 and 70.

Figure 10:
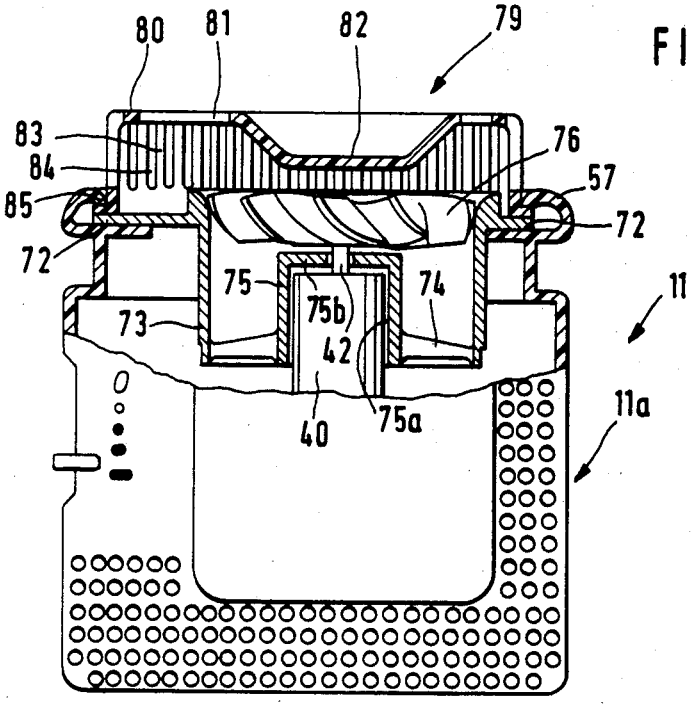
FIG. 10 is a central vertical sectional view of a fourth air supplying apparatus with a modified rotor and with a differently configurated cover for the rotor.
Figure 11:
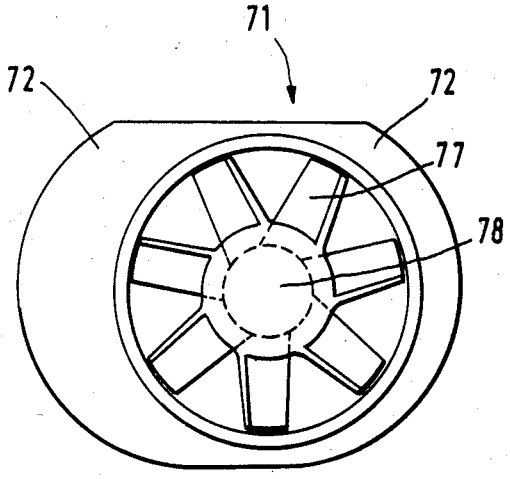
FIG. 11 is a plan view of the rotor and of a bearing member for the electric motor in the apparatus of FIG. 10.

The motor 40 of the air conveying means in the apparatus 11 of FIGS. 10 and 11 is supported in a modified bearing 71 which is installed in the housing 11*a*. The bearing 71 includes a flat collar 72 disposed in a plane which is normal to the axis of the output element 42. The collar 72 cooperates with the adjacent collar 85 of a modified closure or cover 79.

The bearing 71 further comprises an eccentric tubular part 73 which is provided with several radially disposed distancing plates 74 surrounding and connected with a cylinder 75 which corresponds to the cylinder 52 and spacedly surrounds the casing of the motor 40 to define a clearance 75*a*. The distancing plates 74 are spaced apart from each other to define two or more large paths for the flow of heated air between the tubular part 73 (guide means for heated air) and the cylinder 75. The cylinder 75 carries a plate-like closing member 75*b* which has apertures (only one shown) for the flow of air from the clearance 75*a* into the range of the rotor 76. One of the apertures in the closing member 75*b* serves for the passage of the output element 42 which drives the rotor 76. The hub of the rotor 76 is shown at 78; this hub supports an annulus of suitably inclined and configurated vanes or blades 77 which draw cooling air through the cylinder 75 and heated air through the passage between the cylinder 75 and the guide means 73. The blades 77 are inclined with reference to the axis of the output element 42 and their planes make oblique angles with the plane of FIG. 11, i.e., with a plane which is normal to the axis of the output element 42.

The closure or cover 79 constitutes a onepiece part of synthetic plastic material and includes a top wall 80 with a recessed median portion 82 which is adjacent to the hub 78 of the rotor 76 when the closure 79 is properly secured to the major portion of the housing 11*a*. That portion of the top wall 80 which surrounds the recessed median portion 82 is formed with substantially radially extending slots 81. The substantially oval circumferentially extending portion of the cover 79 has axially parallel slots 84 which alternate with ribs 83 extending to the collar 85, i.e., to the locus of attachment of the cover 79 to the collar 72 of the housing 11*a*. The collar 85 can consist of a plurality of legs which can yield during attachment of the cover 79 to the main portion of the housing 11*a* of the apparatus which is shown in FIGS. 10 and 11. If the collar 85 is rigid, it is received in the portion 57 of the housing 11*a* during assembly of the two housing sections with each other.

The recessed central portion 82 of the top wall 80 of the illustrated closure or cover 79 is devoid of slots or other types of passages for the flow of hot air from the interior of the closure into the interior of the extension or extensions of the hood (not shown in FIGS. 10 and 11).

The improved hair dryer is susceptible of many additional modifications. For example, the means for conveying air into the hood can employ otherwise configurated and/or dimensioned rotors which are preferably installed downstream of the heating unit 37 to ensure that heated air is drawn past the wire or wires of the heating unit before it is forced to enter the chamber or chambers of the hood. Furthermore, and as already described above, the rotor is preferably installed in the interior of a closure or cover which is detachable from the main portion of the housing of the air supplying apparatus and is located in the interior of the extension 15 or an analogous extension when the housing is coupled to the hood.

The number and distribution of air admitting ports can be varied without departing from the spirit of the invention. For example, the number of ports 20 or similar ports in the lateral wall 27 can be increased if the selector 18 is installed in another portion of the housing 11*a*. Furthermore, the central portion of the front wall 26 can also serve for admission of air into the compartment of the housing, in addition to or in lieu of certain other parts of the housing. In fact, even the rear wall 26*a* can be formed with ports if the coupling device 16 between the housing 11*a* and the extension 15 is such that the housing 11*a* can be attached to the hood in the orientation which is shown in FIG. 1 as well as after turning through 180 degrees about the axis of the output element 42.

An important advantage of the improved hair dryer is that extensive or complete blocking of the flow of atmospheric air into the interior of the housing 11*a* is highly unlikely or plain impossible. This is due to the fact that the air admitting ports are provided in two or more walls of the housing so that the ports in at least one of the walls can admit atmospheric air even if the ports in the other apertured wall or walls are prevented from establishing communication between the compartment of the housing and the surrounding area.

Another important advantage of the improved hair dryer is that the combined cross-sectional area of all air admitting ports greatly exceeds the combined cross-sectional area of such ports in the housing of a conventional hair dryer. This enables the admitted atmospheric air to flow at a greatly reduced speed so that the likelihood of the development of draft when the dryer is in use is negligible or nil. The flow of atmospheric air into the housing 11*a* at a relatively low speed reduces the likelihood that lightweight garments or portions of garments would be attracted to the outer sides of the apertured walls with attendant partial or complete blocking of air flow into the compartment of the housing.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A hair dryer comprising a hood defining at least one plenum chamber and having a deformable foraminous panel which is adjacent to said chamber and is arranged to at least partially surround the hair on the head of a person wearing the hood so that streamlets of air which flow from the chamber by way of said panel condition the hair; and an apparatus for supplying air into said chamber including a hollow housing having a plurality of walls including at least two apertured walls provided with ports for admission of atmospheric air into said housing, means for causing the thus admitted air to flow into said chamber, said means for causing air flow being confined in said hood, and means for influencing the temperature of air in the interior of said housing.

2. The hair dryer of claim 1, wherein said walls further include an additional wall which is adjacent to the body of the person wearing the hood when said housing is coupled to said extension.

3. The hair dryer of claim 2, wherein said apertured walls include a front wall which is located opposite said additional wall and two lateral walls which flank said additional wall.

4. The hair dryer of claim 1, wherein at least some of said ports have a substantially circular shape.

5. The hair dryer of claim 1, wherein said housing comprises several separable sections.

6. The hair dryer of claim 1, wherein said hood further includes at least one extension which is located at a level below the head of the person wearing the hood, and further comprising means for coupling said housing to said extension so that the housing can be suspended on said hood and guide means provided in said housing to direct admitted air to said means for causing air flow.

7. The hair dryer of claim 6, wherein said guide means includes at least one substantially cylindrical hollow member.

8. The hair dryer of claim 6, wherein said guide means comprises at least one substantially conical hollow member.

9. The hair dryer of claim 1, wherein said means for causing air flow is located in said housing downstream of said temperature influencing means, as considered in the direction of flow of air into said chamber.

10. The hair dryer of claim 9, wherein said housing includes a main portion and said temperature influencing means is installed in said main portion, said means for causing air flow comprising a rotor which is disposed outside of said main portion.

11. The hair dryer of claim 9, wherein said hood further includes at least one extension which is located at a level below the head of the wearer of the hood, and further comprising means for coupling said housing to said extension so that the housing is suspended on said hood, said means for causing air flow including a motor which is disposed in the interior of said extension when said extension is coupled to said housing.

12. The hair dryer of claim 11, wherein said housing further comprises an apertured closure which surrounds said rotor and is also located in said extension when the latter is coupled to said housing.

13. The hair dryer of claim 1, further comprising hollow guide means provided in said housing to direct admitted air to said means for causing air flow, said temperature influencing means comprising a heating unit in the interior of said guide means.

14. The hair dryer of claim 1, wherein said means for causing air flow comprises an electric motor, a rotor which is driven by said motor, and a bearing for said motor, said bearing being installed in said housing.

15. The hair dryer of claim 14, wherein said bearing has a radially outermost portion which is secured to said housing, a tubular member which defines with said motor a clearance, and bridges connecting said tubular member with said radially outermost portion.

16. The hair dryer of claim 15, wherein said tubular member includes a closing member, said motor being disposed at one side and said rotor being disposed at the other side of said closing member and said motor having an output element extending through an aperture of said closing member and connected with said rotor.

17. The hair dryer of claim 1, wherein said means for causing air flow comprises a motor and further comprising means for cooling said motor.

18. The hair dryer of claim 17, wherein said cooling means comprises a cooling element which is arranged to convey atmospheric air from some of said ports to said motor.

19. The hair dryer of claim 18, wherein said apertured walls include a bottom wall which is remote from said motor and said cooling element includes a tube having an intake end inwardly adjacent to said bottom wall.

20. The hair dryer of claim 19, further comprising a bearing for said motor, said bearing including a tubular member spacedly surrounding said motor and defining therewith a substantially annular clearance which receives air from said tube, said bearing being installed in said housing.

21. The hair dryer of claim 1, wherein said means for causing air flow comprises a one-piece rotor of synthetic plastic material and a motor arranged to drive said rotor, said temperature influencing means including an air heating unit located upstream of said rotor, as considered in the direction of air flow from said ports toward said chamber in response to rotation of said rotor.

22. In a hair dryer, an inflatable hood with a foraminous inner panel which is arranged to surround the hair on the head of the wearer of the hood, and an air supplying apparatus comprising a hollow housing having air admitting ports, a motor in said housing, a rotor driven by said motor and arranged to draw air into said housing by way of said ports, said rotor being at least partially confined in said hood, and an air heating unit installed in said housing upstream of said rotor, as considered in the direction of air flow from said ports to said rotor.

23. The apparatus of claim 22, wherein said housing includes a plurality of walls and said ports are provided in at least two of said walls.

24. A hair dryer comprising a hood defining at least one plenum chamber and having a deformable foraminous panel which is adjacent to said chamber and is arranged to at least partially surround the hair on the head of a person wearing the hood so that streamlets of air which flow from the chamber by way of said panel condition the hair, said hood further including at least one extension which is located at a level below the head of the person wearing the hood; an apparatus for supplying air into said chamber including a hollow housing having a plurality of walls including at least two apertured walls provided with ports for admission of atmospheric air into said housing, means for conveying the thus admitted air into said chamber, and means for influencing the temperature of air in the interior of the housing; means for coupling said housing to said extension so that the housing can be suspended on said hood; and guide means provided in said housing to direct admitted air to said conveying means, said guide means comprising a plurality of sleeve-like members and means for securing said sleeve-like members to each other, said sleeve-like menbers together defining at least one passage for the flow of air from said ports to said conveying means and at least one slot which communicates with said passage.

25. The hair dryer of claim 24, wherein said slot has a substantially circular shape.

26. A hair dryer comprising a hood defining at least one plenum chamber and having a deformable foraminous panel which is adjacent to said chamber and is arranged to at least partially surround the hair on the head of a person wearing the hood so that streamlets of air which flow from the chamber by way of said panel condition the hair, said hood further including at least one extension which is located at a level below the head of the person wearing the hood; and apparatus for supplying air into said chamber including a hollow housing having a plurality of walls including at least two apertured walls provided with ports for admission of atmospheric air into said housing, means for conveying the thus admitted air into said chamber, and means for influencing the temperature of air in the interior of the housing; means for coupling said housing to said extension so that the housing can be suspended on said hood; and guide means provided in said housing to direct admitted air to said conveying means, said guide means comprising a plurality of neighboring sleeve-like members having different inner diameters, said apertured walls including a bottom wall which is remote from said air conveying means and the sleeve-like member with smallest inner diameter being inwardly adjacent to said bottom wall.

27. The hair dryer of claim 26, wherein the neighboring sleeve-like members of said guide means define a plurality of substantially annular slots for admission of air from the adjacent ports of said apertured walls into the interior of said guide means.

28. A hair dryer comprising a hood defining at least one plenum chamber and having a deformable foraminous panel which is adjacent to said chamber and is arranged to at least partially surround the hair on the head of a person wearing the hood so that streamlets of air which flow from the chanber by way of said panel condition the hair, said hood further including at least one extension which is located at a level below the head of the person wearing the hood; an apparatus for supplying air into said chamber including a hollow housing having a plurality of walls including at least two apertured walls provided with ports for admission of atmospheric air into said housing, means for conveying the thus admitted air into said chamber, and means for influencing the temperature of air in the interior of the housing; means for coupling said housing to said extension so that the housing can be suspended on said hood; and guide means provided in said housing to direct admitted air to said conveying means, said guide means comprising a plurality of neighboring sleeve-like members having at least substahtially identical inner diameters and defining at least one substantially annular slot for admission of air from the neighboring ports into the interior of said guide means.

29. A hair dryer comprising a hood defining at least one plenum chamber and having a deformable foraminous panel which is adjacent to said chamber and is arranged to at least partially surround the hair on the head of a person wearing the hood so that streamlets of air which flow from the chamber by way of said panel condition the hair, said hood further including at least one extension which is located below the head of the wearer of the hood; an apparatus for supplying air into said chamber including a hollow housing having a plurality of walls including at least two apertured walls provided with ports for admission of atmospheric air into said housing, means for conveying the thus admitted air into said chamber, and means for influencing the temperature of air in the interior of the housing, said air conveying means being located in said housing downstream of said temperature influencing means, as considered in the direction of flow of air in said chamber; means tor coupling the housing to said extension so that the housing is suspended on said hood, said air conveying means comprising a rotor which is disposed in the interior of said extension when said extension is coupled to said housing, said housing further comprising an apertured closure which surrounds said rotor and is also located in said extension when the latter is coupled to said housing, said closure comprising a top wall, a collar which is remote from said top wall, and ribs extending between said top wall and said collar, said ribs defining a plurality of passages for the flow of air from said rotor into said chamber.

30. The hair dryer of claim 29, wherein said ribs are disposed in planes which are inclined with reference to the axis of said rotor.

31. The hair dryer of claim 29, wherein said passages include portions which extend into said top wall.

32. The hair dryer of claim 29, wherein said top wall has additional passages for the flow of air from said rotor into said chamber.

33. The hair dryer of claim 29, wherein said top wall includes an impermeable recessed median portion which is closely adjacent to said rotor.

34. A hair dryer comprising a hood defining at least one plenum chamber and having a deformable foraminous panel which is adjacent to said chamber and is arranged to at least partially surround the hair on the head of a persson wearing the hood so that streamlets of air which flow from the chamber by way of said panel condition the hair; and an apparatus for supplying air into said chamber including a hollow housing having a plurality of walls including at least two apertured walls provided with ports for admission of atmospheric air into said housing, means for conveying the thus admitted air into said chamber including an electric motor and a rotor which is driven by said motor, means for influencing the temperature of air in the interior of said housing, cooling means for supplying cool atmospheric air to said motor, and hollow guide means provided in said housing to direct admitted air to said rotor, said rotor including a first set of vanes arranged to draw air from said cooling means toward and past said motor and a second set of vanes arranged to draw air through said guide means and to force such air into said chamber.

35. The hair dryer of claim 34, wherein said temperature influencing means comprises a heating unit in said guide means.

36. The hair dryer of claim 34, wherein said rotor comprises a hub and the vanes of said first set constitute projections provided on said hub.

37. The hair dryer of claim 36, wherein said projections face said motor.

38. The hair dryer of claim 34, wherein said cooling means comprises a tube which is spacedly surrounded by said guide means, said temperature influencing means comprising at least one insulating support carried by and located outside of said tube and an electrically heatable wire on said support.

39. A hair dryer comprising a hood defining at least one plenum chamber and having a deformable foraminous panel which is adjacent to said chamber and is arranged to at least partially surround the hair on the head of a person wearing the hood so that streamlets of air which flow from the chamber by way of said panel condition the hair; and an apparatus for supplying air into said chamber including a hollow housing having a plurality of walls including at least two apertured walls provided with ports for admission of atmospheric air into said housing, means for conveying the thus admitted air into said chamber comprising a one-piece rotor of synthetic plastic material and a motor arranged to drive said rotor, said rotor comprising a hub having projections arranged to draw air past said motor, a rim spaced apart from said hub and a set of blades extending between said hub and said rim and arranged to force air to flow from said ports into said chamber, and means for influencing the temperature of air in the interior of the housing including an air heating unit located upstream of said rotor, as considered in the direction of air flow from said ports toward said chamber in response to rotation of said rotor.

40. The hair dryer of claim 39, wherein said rotor further comprises an intermediate portion surrounding said hub and said blades extend between said intermediate portion and said rim.

41. A hair dryer comprising a hood defining at least one plenum chamber and having a deformable foraminous panel which is adjacent to said chamber and is arranged to at least partially surround the hair on the head of a person wearing the hood so that streamlets of air which flow from the chamber by way of said panel condition the hair; and an apparatus for supplying air into said chamber including a hollow housing having a plurality of walls including at least two apertured walls provided with ports for admission of atmospheric air into said housing, means for conveying the thus admitted air into said chamber, motor means for said conveying means, means for influencing the temperature of air in the interior of the housing, and discrete means provided within said housing for guiding the air from said ports directly to said influencing means.

* * * * *